US005863885A

United States Patent [19]

Ruggieri et al.

[11] Patent Number: 5,863,885

[45] Date of Patent: Jan. 26, 1999

[54] PACK CONTAINING A DRY ALKALINE SOLID

[75] Inventors: Juan Carlos Ruggieri; Heiner Deibig; Lee Wielgolinski, all of Biberist, Switzerland; Jan Staal; Guido van den Brom, both of Maarssen, Netherlands

[73] Assignee: Diversey Lever, Inc., Plymouth, Mich.

[21] Appl. No.: 957,039

[22] Filed: Oct. 24, 1997

[30] Foreign Application Priority Data

Oct. 24, 1996 [DE] Germany ..... 196 44 176.5

[51] Int. Cl.[6] ..... C11D 17/04; C11D 3/37

[52] U.S. Cl. ..... 510/439; 510/218; 510/224; 510/296; 510/298; 510/475; 510/476; 206/524.5; 206/524.7

[58] Field of Search ..... 510/439, 224, 510/296, 218, 475, 298, 476; 206/524.5, 524.7

[56] References Cited

U.S. PATENT DOCUMENTS

| | | | |
|---|---|---|---|
| 3,417,162 | 12/1968 | Zimmerman et al. | 260/837 |
| 3,441,424 | 4/1969 | Bolgiano | 117/12 |
| 4,082,854 | 4/1978 | Yamada et al. | 426/106 |
| 4,469,728 | 9/1984 | Belz | 428/36 |
| 4,551,369 | 11/1985 | Belz | 428/36 |
| 4,612,355 | 9/1986 | Belz | 526/65 |
| 4,747,976 | 5/1988 | Yang et al. | 510/439 |
| 4,870,148 | 9/1989 | Belz et al. | 526/318.41 |
| 4,981,885 | 1/1991 | Engel et al. | 523/409 |
| 5,322,878 | 6/1994 | Deibig et al. | 524/414 |
| 5,362,532 | 11/1994 | Famili et al. | 428/36.6 |
| 5,364,910 | 11/1994 | Takinishi et al. | 525/327.3 |
| 5,378,751 | 1/1995 | Deibig et al. | 524/414 |
| 5,429,874 | 7/1995 | Vanputte | 428/522 |
| 5,604,042 | 2/1997 | Bianchini et al. | 428/507 |

FOREIGN PATENT DOCUMENTS

| | | |
|---|---|---|
| 0457600 | 11/1991 | European Pat. Off. . |
| 652 724 | 5/1995 | European Pat. Off. . |
| 06322007 | 11/1994 | Japan . |
| 92/20775 | 11/1992 | WIPO . |

*Primary Examiner*—Lorna Douyon
*Attorney, Agent, or Firm*—A. Kate Huffman

[57] ABSTRACT

A pack contains a dry alkaline solid (1), which produces in an aqueous media a pH value exceeding 10, which consists of at least a one-layer packaging and which contains at least one polymer film (3) soluble in aqueous alkaline media. The polymer film contains two phases, whereby the continuous phase is made of a copolymer or terpolymer of α-β unsaturated monocarboxylic acid which has a COOH group and the discontinuous phase is formed by a polymer which has an epoxy group, whereby both polymers are bonded in the boundary layer through esterification between COOH groups of the copolymer or terpolymer and epoxy groups of the discontinuous phase polymer.

18 Claims, 1 Drawing Sheet

PACK CONTAINING A DRY ALKALINE SOLID

FIELD OF THE INVENTION

The invention relates to a pack, containing a dry alkaline solid, producing a pH-value of over 10 in an aqueous medium. The solid is contained in a packaging consisting of at least one layer, which has at least one polymer film soluble in an alkaline aqueous medium, whereby the film contains a copolymer or a terpolymer of an α-β unsaturated monocarboxylic acid, having a COOH group.

BACKGROUND OF THE INVENTION

Packs of this nature are described in WO 92/20775. The pack contains a prescribed amount of strongly alkaline and hence aggressive cleaning agent, which is apportioned in the dosing unit of washing or rinsing machines, in particular professional machines of this kind. The film surrounding the alkaline solid should protect against contact with the alkaline solid during handling. On the other hand, the film should dissolve or disintegrate in an aqueous alkaline medium by itself, so that separate evacuation and hence handling of such film when or after releasing the solids is not required anymore.

The way of using so-called wash blocks is described in EP-652,724 B1, the contents of which are referred to here.

The general application of packs containing water soluble cleaning agent is affected by problems of physical and chemical compatibility of the films with water and cleaning systems. Many films, for instance those made of polyvinyl pyrrolidine, polyethyl-oxazoline and polyvinyl-alcohol are able to react with active components of a cleaning system. Such films are moisture sensitive and may soften and loose their strength under the effect of the moisture. More important, however, is the fact that many chemicals used in cleaning compounds attack the films and may cause defects in the sealing and/or the water solubility of the pack, particularly if the pack is stored under moist conditions.

In the above mentioned WO 92/20775, several types of films are described. As a rule, multilayer composite films are provided, in which the various layers have a different composition. One of these layers may consist of a copolymer, or a terpolymer of an α-β unsaturated monocarboxylic acid, possessing a COOH group.

Plastics possessing a COOH-group, which are soluble in aqueous alkaline solution and which are stable in aqueous acid media and generally also in neutral aqueous media, are known in the art. In this context, we refer to the following European disclosures: EP-A-143,935 and EP-A-032,244. From EP-A-314,156, plastics that can disintegrate in neutral aqueous media are also known.

DEFINITION OF THE INVENTION

The objective of the invention is to improve the physical and mechanical properties of the packaging surrounding the alkaline solid, without worsening of the solubility, respectively the disintegradabiltiy, of the film in alkaline aqueous media and without impairing the chemical stability with regard to dry and strongly alkaline substances. This problem is solved by the fact that the polymer of the film is a two-phase polymer combination, wherein the continuous phase is made of the copolymer or terpolymer possessing a COOH group and the discontinuous phase is made of a polymer possessing an epoxy group, whereby both polymers are bonded at their boundary surface by esterification between the COOH group of the copolymer or terpolymer and the epoxy group of the polymer of the discontinuous phase.

Accordingly, the present invention provides a pack, containing a dry alkaline solid, which at a concentration of 1% in an aqueous media, produces a pH value exceeding 10, and which is contained in a packaging consisting of at least one layer, which packaging consists of at least one polymer film, according to claim 1.

DETAILED DESCRIPTION OF THE INVENTION

Figure 2:
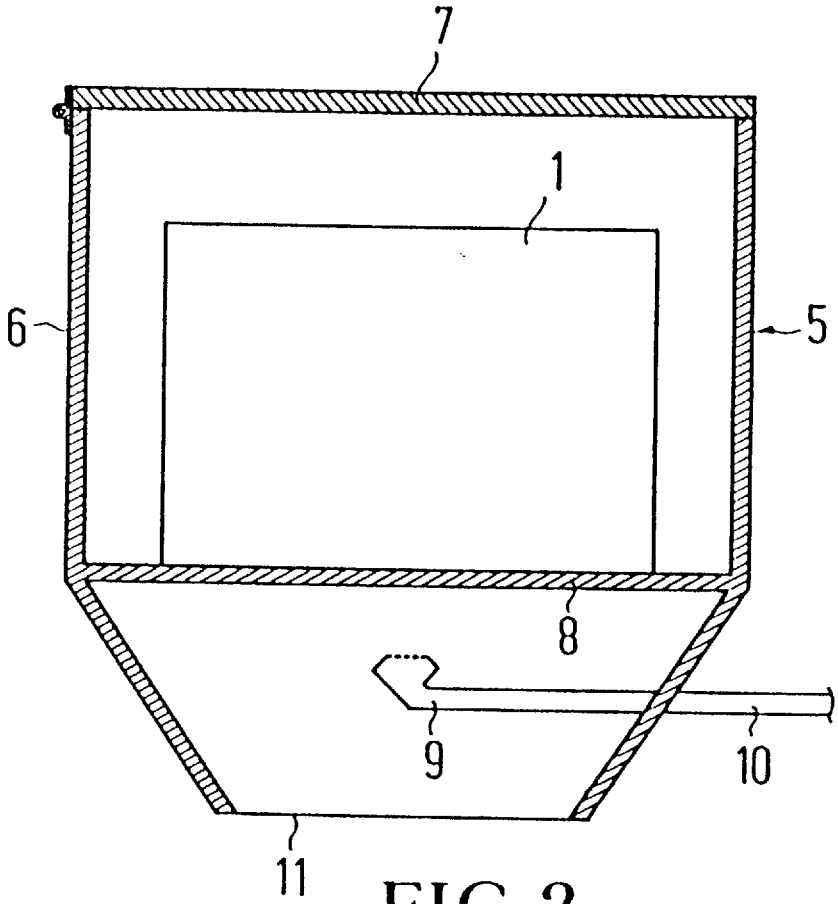

A film made of a polymer according to the invention is stable towards strongly alkaline substances, as long as the latter are present as a dry solid. As a packaging film for alkaline portion packs, the film possesses excellent physical and mechanical properties, that will be discussed more in detail below. It is therefore not necessary to structure a film with multiple layers of different composition. Structuring the film as a single layer film of the above mentioned polymer is sufficient. The film may be in direct contact with the alkaline solids. The film thickness may vary within wide limits according to the size of the pack and other conditions, and is generally between 10 μm and 300 μm, in particular between 30 μm and 150 μm. Because of the two-phase structure made of two different polymers, bonded at the boundary surface by covalent bonds, the film has excellent tensile strength. Its elongation at breaking point may amount to more than 200%, in particular more than 300%. Furthermore the film remains flexible within a wide temperature range, due to its two-phase structure. It retains its flexibility between −20° C. and +60° C., which is a particular advantageous feature for the intended use. As a general rule, the film fully encloses the alkaline solid, so that the latter is tightly wrapped in the film. For this purpose, the film may be sealed by welding or gluing. The alkaline solids may be present in the form of a powder, granules or in the form of blocks. The blocks may have a weight of 20 g up to 5 kg, preferably 1 kg up to 4 kg. According to the intended use, the alkaline solid, respectively the cleaning agent, generally consists of several components and may have the composition of an usual washing or rinsing agent, possessing preferably also bleaching and/or disinfecting components and properties. The cleaning block according to the invention contains as a general rule maximum 30 wt. %, in particular max. 10 wt. % free or chemically bound water, whereby the free water content of the pack is preferably max. 8 wt. %.

The packaging may consist solely of the film, in particular the single layer film. This is in particular the case when the pack is stored in a dry place and in particular when several packs are protected against mechanical damage by means of a common cardboard box or something like it. It is however also possible that the film packaging is covered with a watertight wrapping on the outside, which protects it from moisture penetration, so that each individual pack shows, apart from the film, also the protective wrapping. The protective wrapping may be made open or easy to open, so that the portion unit, consisting of the alkaline solids and the film surrounding it, may be easily removed from the wrapping and added to the washing or rinsing machine for which it is intended to be used. Upon use, minimal alkaline residues in the dose measuring unit of the machine are sufficient for dissolving the film by means of water entering from the outside. If such residues are not available then the moisture which diffuses through the film when the water enters is sufficient to dissolve the alkaline solids so far that the film will be dissolved from the inside. At the usual increased washing or rinsing temperatures, the film dissolves faster than at room temperature. It is essential that the polymer film according to the invention does not contain polyvinyl-alcohol.

The film of the pack according to the invention dissolves without residue in aqueous alkaline solution. This is not a true dissolution, since the particles of the discontinuous phase are becoming dispersed in the aqueous alkali. This is probably due to the fact that the polymer which possesses an epoxy group is not soluble in water or in aqueous alkaline solutions. However, because of their esterification, the polymer particles are covered at their surface with COOH-group molecules, which free COOH group molecules react with the aqueous alkaline under formation of salts. Therefore the COOH-group molecules act as a detergent or dissolving aid for the particles of the polymer with the epoxy groups, so that the latter are present in finely dispersed form in the aqueous alkali and are removed without residue with the washing or rinsing water used.

The particle size of the discontinuous polymer is generally between 0.3 and 30 $\mu$m, in particular between 1 and 10 $\mu$m, whereby a particle size in the lower range is being referred for thin polymer films. At maximum approximately 1%, generally less than 0.1% of the carboxyl groups of the polymer with a COOH group are bonded by epoxy groups of the dispersed polymer. Normally, this concerns only 1 to 2 COOH groups per reacted molecule in the boundary surface. In aqueous alkaline or basic media, at least approximately 75 wt. %, as a general rule at least approximately 90 wt. %, in particular at least approximately 95 wt. % of the originally used polymer with a COOH group is soluble.

Because cross-linking is insignificant or may be limited to an insignificant level, the polymer of the film possesses thermoplastic properties, which is very favourable for its manufacturing and also for its handling, e.g. for welding the film in order to fully enclose the alkaline solids.

The weight ratio between continuous polymer and discontinuous polymer is preferably between 90:10 and 50:50, whereby the amount of continuous polymer preferably exceeds the amount of discontinuous polymer.

The polymer with an epoxy group is preferably a copolymer or a terpolymer, incorporating a monomer which has epoxy groups. The weight ratio of the monomer with an epoxy group is preferably below 10 wt. %, in particular below 5 wt. %. Generally, for the purposes according to the invention, 1 to 2.5 wt. % are sufficient. In this way, it is possible to achieve that the discontinuous polymer particles only show a relatively small amount of free epoxy groups at their surfaces, which are capable to react with the carboxyl groups of the polymer with a COOH-group during manufacturing of the polymer, thus, as mentioned before, making it possible to avoid an undesirable level of cross-linking reactions. The polymer with the epoxy groups is preferably a copolymer or terpolymer of glycidyl-acrylate or glycidyl-methacrylate, the latter being preferred. The preferred co-monomer is ethylene. The preferred termonomers are methacrylic acid ester and acrylic acid ester, the latter being preferred. The alcohol component of the ester may have 1 to 10 C-atoms. The polymer with the COOH-group is preferably a copolymer or terpolymer of acrylic acid or methacrylic acid with an acrylate or methacrylate as co-monomer. The alcohol component of the acrylate or methacrylate may again consist of 1 to 10 C-atoms. The preferred termonomer is styrene. Terpolymers of butyl-acrylate, styrene and acrylic acid or methacrylic acid are particularly suitable.

For manufacturing the two phase film, both polymers may initially be produced separately and be present in the form of granulates. Both granulates may be pre-mixed in the solid state and are then melted together preferably under the influence of shear forces. The melting and dispersing in of the polymer with an epoxy group may be advantageously carried out with a twin screw extruder with synchronously running screws. In doing so, the particle size of the dispersed phase in the continuous phase may be influenced and hence regulated by an appropriate selection of the screw geometry, screw rotating speed, mixing temperature and the length of stay in the extruder. The polymer produced in this way may be extruded in strands and then pelletized. However, it is also possible and in many cases preferable, to extrude the film immediately as flat or tubular film from the obtained combined (two-phase) melt, for instance by using a flat or tubular extruder slit.

The two-phase polymer combination may be used as such without any further complements such as fillers, additives and similar substances. In particular cases, however, it may be preferable, to add, during manufacturing, also small amounts of dispersion agents, in particular silicone oil, lubricants such as stearic acid amide and erucic acid amide, as well as fillers, such as titanium dioxide.

Other features and advantages of the invention are shown by means of the following description of examples in relation with the subclaims. Herein, each time the individual features may be realised alone or in combination with each other in executions of the invention as well as by means of the drawing.

EXAMPLE 1

Preparation of a polymer having a COOH group for a film flexible at low temperature by means of continuous polymerisation in an agitator vessel reaction extruder system.

Recipe in weight per cent:

20% styrene

60% butyl-acrylate

20% acrylic acid 0.1% n-dodecyl-mercaptane additive

The monomer mixture is fed to the agitator vessel Mass temperature in the agitator vessel: 134° C. Fixed bed in the agitator vessel: 50 kg Flow rate: 50 kg/hr.

After the reaction in the agitator vessel, one obtains a 30–40% solution of the polymer in the residual monomer mixture. The solution is fed to a reaction extruder (Berstorff ZE 90 twin screw extruder, about 22 l free volume). The polymerisation temperature amounts to about 145° C. To the first extruder zone, 0.3% initiator (tertbutyl peroxy benzoate) based on the monomer mixture, dissolved in n-butyl acetate, is added.

The polymer melt (conversion about 90%) is then fed to a degassing extruder ZE 60A (free volume about 6 l) and reduced to a residual monomer content of 100 to 200 ppm. The degassed polymer melt is passed through a strand nozzle, cooled on a cooling belt and pelletized in a cutting station.

Polymer properties:

Molecular weight Mw: 155 000 g/mol

Molecular weight Mn: 26 000 g/mol

Ununiformity: 6

Melt index at 150° C./2.16 kg : 42 g/10 min

Carboxyl content: 11.4%

Glass transition temperature: 40° C.

Softening temperature: 110° C. (Kofler bank)

The terpolymer contains about 70 carboxyl groups per polymer molecule.

A monomer mixture of

20% styrene

55% butyl acrylate

25% methacrylic acid with the usual additives is also extremely suitable.

EXAMPLE 2

Compounding and manufacturing a film from a two-phase polymer combination.

The compounding of the polymer with a COOH group according to example 1 with a polymer having an epoxy group for obtaining the final product is normally carried out in a twin screw extruder rotating in the same direction. For this purpose, the extruder is fitted with screws with predominantly "short" transport elements with high raise. The length of stay in the extruder amounts to about 3 minutes. During compounding vacuum degassing is carried out, the residual monomer content is lowered to less than 50 ppm.

As polymer having an epoxy group, a commercial grade terpolymer of ethylene, acrylic acid butyl ester and glycidyl-methacrylate with 2.5 wt. % glycidyl-methacrylate was used. It has the following properties Molecular weight Mw: 100 000 g/mol Molecular weight Mn: 20 000 g/mol.

The polymer contains about 3.5 epoxy groups per molecule of polymer.

Recipe:

60% polymer with a COOH group according to example 1.

40% polymer with an epoxy group according to the above recipe.

Compounding conditions:

Extruder temperature: 200° C.

Screw speed: 100 rpm

Pelletizing properties:

Carboxyl content: about 7%

Melt index at 190° C./5 kg: about 12 g/10 min

Glass transition temperature: 40° C.

The melt of the two-phase polymer combination is immediately extruded as film through a flat sheet slit.

Film properties:

Tensile strength: 18N/mm$^2$

Elongation: 340%

Flexible down to: −20° C.

EXAMPLE 3

Preparation of portion packs of washing agent

A washing machine detergent mixture for use in industrial washing machines was blended from the following components (in weight per cent):

32.0% Sodium-tripolyphosphate 2.0% Ketone—fatty alcohol mixture 12.5% of a mixture of 40% polyacrylate (MW 4500), 30% sodium silicate ($SiO_2$:$Na_2O$=2) and 30% sodium carbonate.

50.0% sodium hydroxide pellets 3.5% sodium dichloro-isocyanurate. $H_2O$

The mixture is made into blocks of 3 kg each. The washing agent is hygroscopic and strongly alkaline. Skin contact should be avoided.

The film according to example 2 (film thickness 30 $\mu$m) is pulled from a roll and transferred to a conveyer belt. Subsequently, the washing blocks are deposited onto the film and wrapped in it. Sealing is done by means of welding-cutting. Hence the washing agent blocks are tightly enclosed in the two-phase polymer film. The thus prepackaged washing agent blocks are individually enclosed in an orientated polypropylene (OPP) bag, for protection against mechanical damage and entering of moisture and the bag is also sealed by welding. In this form, the packs are stable under storage for long periods of time under ambient conditions, for instance 20°–30° C. and 60% relative humidity. Before use, the propylene bags loosely wrapped around the portion packs are mechanically opened. The portion pack consisting of the washing agent block and the film surrounding it is removed and inserted into the dose measuring unit of the washing machine, as described in EP 0 652 724 B1. Upon starting the washing process, the polymer film is dissolved without residue within a short period, depending on the film thickness, of at utmost within 2 minutes. Subsequently, the washing agent block is progressively dissolved.

Figure 1:
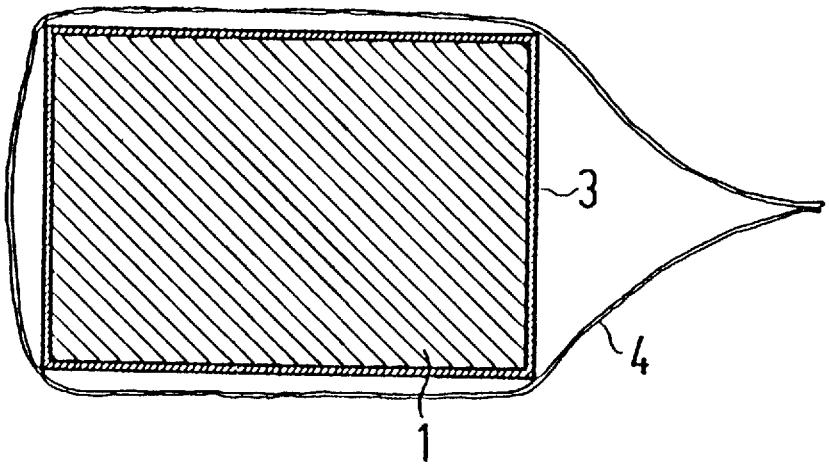

In the drawings,

FIG. 1 shows the cross section of a washing block in the ready-to-use form and FIG. 2 schematically shows the washing block according to FIG. 1 in the dosing unit of an industrial washing machine.

A washing agent of the usual composition is pressed into a rectangularly shaped washing agent block 1 by means of a compression device. The washing block 1 is completely surrounded by the polymer film 3 according to example 3, whereby the joints in the polymer film are sealed through welding. The sealed washing agent block is put into a bag 4 consisting of orientated polypropylene, which loosely surrounds the washing block. The bag may also be executed as a carrier bag with a handle. Before using the washing block 1, bag 4 is mechanically opened. Washing block 1 is then inserted into a dosing unit 5 of a washing machine, of which the housing 6 is fitted on the top side with a lid 7 which can be opened. The housing includes a grid 8, on which the washing block 1 is placed. Below the grid, a spray nozzle 9 is fitted, the spray of which is directed towards the washing block 1, and connected to a water feed 10. During operation, the required amount of water is sprayed through grid 8 onto the washing block whereby washing agent is dissolved from it. The water containing the washing agent thereafter can escape through the lower opening 11 and fed to the washing process. As a general rule, a new washing block is placed before the previous one is completely used up. The alkaline medium surrounding the old washing block is sufficient to dissolve the sealing film 3, which encloses block 1, within a short period. The dissolved polymer does not disturb the washing process and is removed together with the washing water used.

We claim:

1. Pack containing a dry alkaline solid which, at a concentration of 1% in an aqueous media, produces a pH value exceeding 10, and contained in a packaging consisting of at least one layer, which packaging consists of at least one polymer film, which is soluble in an aqueous alkaline medium, whereby the film contains a copolymer or a terpolymer of an $\alpha$-$\beta$ unsaturated monocarboxylic acid, having a COOH-group, wherein the film contains a two-phase polymer combination, whereby the continuous phase is formed by the copolymer or terpolymer containing the COOH-group and the discontinuous phase is formed by a polymer containing an epoxy group and both phases are being bonded at their boundary layer through esterification between COOH groups of the copolymer or the terpolymer and epoxy groups of the polymer of the discontinuous phase, wherein the polymer containing the epoxy group is a copolymer of glycidyl acrylate or glycidyl methacrylate with ethylene or a terpolymer of glycidyl acrylate or glycidyl methacrylate with ethylene and an acrylic acid ester or methacrylic acid ester.

2. Pack according to claim 1, wherein the film is a single layer film.

3. Pack according to claim 1, wherein the film has a thickness of 10 to 300 $\mu$m.

4. Pack according to claim 1, wherein the film shows an elongation at the breaking point of more than 200%.

5. Pack according to claim 1, wherein the film is flexible in the temperature range of −20° C. to +60° C.

6. Pack according to claim 1, wherein the alkaline solid is tightly wrapped in the film.

7. Pack according to claim 1, wherein the packaging solely consists of the film.

8. Pack according to claim 1, wherein the packaging consist of the film and a covering of a film which protects against entering of moisture.

9. Pack according to claim 1, wherein the alkaline solid is a cleaning agent.

10. Pack according to claim 1, wherein the alkaline solid is a washing or a rinsing agent.

11. Pack according to claim 1, wherein the film is dissolved without residue in aqueous alkaline solutions.

12. Pack according to claim 1, wherein the particle size of the discontinuous polymer is in the range of 0.3 to 30 $\mu$m.

13. Pack according to claim 1, wherein that a maximum 1% of the COOH groups of the continuous polymer is bonded to epoxy groups of the discontinuous polymer.

14. Pack according to claim 1, wherein the polymer possesses thermoplastic properties.

15. Pack according to claim 1, wherein the weight ratio between the continuous polymer and the discontinuous polymer is in the range of 90:10 to 50:50.

16. Pack according to claim 1, wherein the ratio of monomer having epoxy groups to polymer having epoxy groups is below 10 wt. %.

17. Pack according to claim 1, wherein the polymer having a COOH-group is a copolymer of acrylic acid or methacrylic acid with an acrylate or a methacrylate or a terpolymer of acrylic acid or methacrylic acid with an acrylate or a methacrylate and styrene.

18. Pack according to claim 1, wherein the polymer film is free from polyvinyl alcohol.

* * * * *